US008408941B2

(12) United States Patent
Akino

(10) Patent No.: US 8,408,941 B2
(45) Date of Patent: Apr. 2, 2013

(54) CONDENSER MICROPHONE AND ITS OUTPUT CONNECTOR

(75) Inventor: Hiroshi Akino, Machida (JP)

(73) Assignee: Kabushiki Kaisha Audio-Technica, Machida-Shi (JP)

( * ) Notice: Subject to any disclaimer, the term of this patent is extended or adjusted under 35 U.S.C. 154(b) by 158 days.

(21) Appl. No.: 13/067,347

(22) Filed: May 26, 2011

(65) Prior Publication Data

US 2012/0009819 A1 Jan. 12, 2012

(30) Foreign Application Priority Data

Jul. 7, 2010 (JP) ..... 2010-154711

(51) Int. Cl.
*H01R 13/648* (2006.01)
*H01R 13/66* (2006.01)

(52) U.S. Cl. ..... 439/607.28; 439/620.24

(58) Field of Classification Search ..... 439/607.28, 439/620.09, 620.13, 620.14, 620.15, 620.24
See application file for complete search history.

(56) References Cited

U.S. PATENT DOCUMENTS

| | | | | |
|---|---|---|---|---|
| 7,063,546 | B2 * | 6/2006 | Akino | 439/620.21 |
| 7,104,844 | B2 * | 9/2006 | Akino | 439/620.21 |
| 7,540,780 | B2 * | 6/2009 | Akino | 439/620.14 |
| 7,927,147 | B1 * | 4/2011 | Shaw et al. | 439/620.13 |
| 8,038,476 | B2 * | 10/2011 | Chen | 439/620.13 |
| 8,066,531 | B2 * | 11/2011 | Kanatsu | 439/620.22 |
| 2011/0235830 | A1 * | 9/2011 | Akino | 381/174 |

* cited by examiner

*Primary Examiner* — Xuong Chung Trans
(74) *Attorney, Agent, or Firm* — Manabu Kanesaka

(57) ABSTRACT

In an output connector for a condenser microphone, which has a printed wiring board mounted with a capacitor element for preventing intrusion of high-frequency waves and a Zener diode element for preventing circuit destruction due to static electricity, the generation of noise caused by the Zener diode element is reduced. In the output connector configured such that on a connector base 11 through which a first pin for earthing and second and third pins for signal are penetratingly provided, a capacitor element 148 for preventing intrusion of high-frequency waves and a Zener diode element 149 for preventing circuit destruction due to static electricity are mounted in parallel on the upper surface side thereof, and a printed wiring board 14 formed with an electrostatic shield layer consisting of a copper foil is formed on the lower surface side thereof, a magnetic sheet 16 is disposed between the connector base 11 and the electrostatic shield layer of the printed wiring board 14, and a low-pass filter of LC is formed by the inductance component L caused by the magnetic sheet 16 and the capacitance component C of the capacitor element.

4 Claims, 5 Drawing Sheets

CONDENSER MICROPHONE AND ITS OUTPUT CONNECTOR

CROSS-REFERENCE TO RELATED APPLICATION

The present application is based on, and claims priority from, Japanese Application Serial Number JP2010-154711, filed Jul. 7, 2010, the disclosure of which is hereby incorporated by reference herein in its entirety.

TECHNICAL FIELD

The present invention relates to an output connector for a condenser microphone. More particularly, it relates to an output connector for a microphone, which has a function of shielding high-frequency electromagnetic waves radiated from a cellular phone or the like, and a condenser microphone provided with the said output connector.

BACKGROUND ART

A condenser microphone is configured so that an electrostatic acousto-electric converter in which a diaphragm and a backplate are arranged opposedly is included in a microphone unit, and an impedance converter such as a field effect transistor (FET) is incorporated because of its very high impedance. Usually, in the condenser microphone, a phantom power source is used, and microphone sound signals are delivered via a balanced shielded cable for the phantom power source.

To connect the balanced shielded cable, a 3-pin type output connector, for example, specified in EIAJ RC-5236 "Latch Lock Type Round Connector for Audio Equipment" is provided on the microphone casing side. By this output connector, the balanced shielded cable can be attached to and detached from the condenser microphone.

If strong electromagnetic waves radiated from a cellular phone or the like are applied to a microphone casing or a microphone cable in the state in which the balanced shielded cable is connected to the output connector, a which the balanced shielded cable is connected to the output connector, a high-frequency current inherent in the electromagnetic waves intrudes into the microphone casing through the output connector, and sometimes is detected by the impedance converter or the like and is delivered from the microphone as audible frequency noise.

As one method for preventing the generation of this kind of noise, the present applicant has proposed an output connector of microphone having a shielding function in Japanese Patent Application Publication No. 2005-311752. The configuration of this output connector is explained with reference to FIGS. 5 and 6. FIG. 5A is a front view of the output connector, in which only a shield cover is shown as a cross section, FIG. 5B is a sectional view taken along the line B-B of FIG. 5A, FIG. 6A is a lower plan view of a printed wiring board disposed on the output connector, and FIG. 6B is an upper plan view of the printed wiring board.

An output connector 10 includes a disc-shaped connector base 11 consisting of an electrical insulator such as PBT (polybutylene terephthalate) resin. In the connector base 11, three pins of a first pin E for earthing, a second pin SH on the hot side of signal, and a third pin SC on the cold side of signal are provided, for example, by press fit.

In this specification, the first pin E for earthing is sometimes referred simply to as the "earthing pin E", and the second pin SH on the hot side of signal and the third pin SC on the cold side of signal are sometimes referred simply to as the "signal pin SH" and "signal pin SC", respectively.

As shown in FIG. 5B, the output connector 10 is mounted in an end portion of a microphone casing (microphone grip for the handheld microphone), not shown, via a connector housing 20. The connector housing 20 consists of a cylindrical body made of a metal such as a brass alloy, and also functions as the shield casing of the output connector.

In the connector base 11, an internally threaded hole 13 is formed toward the inside in the radial direction from the outer peripheral surface thereof. In the internally threaded hole 13, a male screw 12 for fixing the output connector 10 to the connector housing 20 is threadedly mounted.

According this configuration, as shown in FIG. 5B, by using a screwdriver or the like, not shown, through a round hole 21 formed in the connector housing 20, the male screw 12 is turned, pulled out to the outside in the radial direction, and caused to butt against the peripheral edge of the round hole 21. Thereby, the output connector 10 can be fixed firmly to the connector housing 20.

In fixing the output connector 10 in the connector housing 20, the earthing pin E is electrically connected to the connector housing 20 serving as the earth via a conductive member such as a plate spring, not shown.

According to Japanese Patent Application Publication No. 2005-311752, to prevent electromagnetic waves radiated from a cellular phone or the like from intruding into the microphone casing, a printed wiring board 14 and a shield cover 15 are provided on the base inner surface (the surface arranged on the inside of microphone, the upper surface in FIGS. 5A and 5B) side of the connector base 11.

The printed wiring board 14 is a double-sided printed board having three insertion holes 141, 142 and 143 through which the earthing pin E and the signal pins SH and SC penetrate. As shown in FIG. 6A, on a lower surface (a surface facing the connector base) 14B of the printed wiring board 14, a shield layer 144 consisting of a copper foil solid pattern is formed. The shield layer 144 is formed so as to exclude portions around the insertion holes 142 and 143 through which the signal pins SH and SC are inserted.

As shown in FIG. 6B, on an upper surface 14A of the printed wiring board 14, a shield electrode 145 is formed throughout the entire periphery thereof. The shield electrode 145 and the shield layer 144 on the lower surface side are connected electrically to each other via plating in a plurality of through holes 146.

The through hole plating is also applied in the insertion hole 141. The earthing pin E is electrically connected to the shield layer 144 via the through hole plating in the insertion hole 141. In the insertion holes 142 and 143 as well, the through hole plating is applied to ensure the electrical connection with the signal pines SH and SC.

In this example, the pin insertion hole 141 for the earthing pin E is connected to two locations of the shield electrode 145 by lead wires 147*a* and 147*b* extending from the edge of the pin insertion hole 141 to the directions opposite to each other.

Also, the pin insertion holes 142 and 143 for the signal pins SH and SC are connected to the shield electrode 145 by lead wires 147*c* and 147*d*, respectively. In an intermediate portion of each of the lead wires 147*c* and 147*d*, a capacitor element 148 and a Zener diode element 149 are mounted in parallel.

That is, to between the earthing pin E and the signal pin SH and to between the earthing pin E and the signal pin SC, the capacitor element 148 and the Zener diode element 149 are connected in parallel. The capacitor element 148 prevents intrusion of high-frequency waves. The Zener diode element 149 prevents circuit destruction due to static electricity.

The shield cover 15 includes a ceiling part 151 that covers the upper surface 14A of the printed wiring board 14 and a skirt part 152 that is fitted on the outer peripheral surface of the connector base 11. In the ceiling part 151, three through holes through which the earthing pin E and the signal pins SH and SC penetrate are formed.

Among these through holes, the through hole for the earthing pin E is formed as a hole having a diameter approximately equal to the diameter of the earthing pin E so as to be capable of being in contact with the earthing pin E to electrically connect the earthing pin E and the shield cover 15 to each other. The earthing pin E is soldered to the shield cover 15.

The through holes for the signal pins SH and SC are formed so as to have diameters larger than the diameters of the signal pins SH and SC so as to be in noncontact with the pins. These through holes are preferably formed so as to have diameters as small as possible to restrain the leak of a high-frequency magnetic field, which is generated from the wiring portion and the like, into the microphone casing to a minimum when the high-frequency current flows in the capacitor element 148.

According to the output connector 10 having the above-described configuration, double shield is formed by the shield layer 144, which consists of the copper foil solid pattern formed on printed wiring board 14, and the shield cover 15. Also, by the capacitor element 148 mounted on the printed wiring board 14, the intrusion of the high-frequency current caused by electromagnetic waves coming through the signal pins SH and SC can be inhibited.

Also, the capacitor element 148 and the Zener diode element 149 are mounted in parallel, and when a current flows from the signal pin SH, SC side toward the earthing pin E, the current flows in the Zener diode element 149, and then flows in the capacitor element 148. Therefore, the capacitor element 148 can be protected from electrostatic destruction.

Recently, concerning the prevention of the generation of noise caused by extraneous electromagnetic waves, it has been demanded that noise be not generated even in a situation where electromagnetic waves having a high field intensity of, for example, about 1 GHz is applied to the microphone. To meet this demand, the countermeasures using electrostatic shield in the conventional example are insufficient.

Accordingly, in the Japanese Patent Application Publication No. 2010-067711, the present applicant has proposed that a magnetic sheet is provided additionally on the shield cover 15. According to this configuration, due to the high-frequency magnetic field generated in the capacitor element 148, a high-frequency current is caused to flow by induction in the printed wiring board for sound signal output in the microphone casing and the circuit parts mounted on the printed board, so that the generation of noise can be prevented.

On the other hand, the printed wiring board 14 is provided with the Zener diode element 149 in parallel with the capacitor element 148. Especially in a situation where the printed wiring board 14 is exposed to higher-frequency and strong field intensity, the Zener diode element also poses a problem.

That is, since the Zener diode element is also a semiconductor non-linear element, when strong electromagnetic waves are applied to a microphone cable, the high-frequency current caused by the electromagnetic waves is detected, and audible frequency noise is sometimes generated.

Accordingly, an object of the present invention is to provide an output connector for a condenser microphone, which has a printed wiring board mounted with a capacitor element for preventing intrusion of high-frequency waves and a Zener diode element for preventing circuit destruction due to static electricity and is configured so that the generation of noise caused by the Zener diode element is reduced.

SUMMARY OF THE INVENTION

To achieve the above object, the present invention provides an output connector for a condenser microphone, in which a first pin for earthing and second and third pins for signal are penetratingly provided in a connector base consisting of an electrical insulator; the output connector is mounted in an end portion of a microphone casing in a state in which the first pin is electrically connected to the microphone casing; the output connector includes a printed wiring board, which is arranged on the base inner surface side of the connector base and through which the pins are inserted, and a shield cover, which is arranged on the base inner surface side so as to cover the printed wiring board and through which the pins are inserted; and the printed wiring board is a double-sided board, on the board upper surface side facing the shield cover, a capacitor element for preventing intrusion of high-frequency waves and a Zener diode element for preventing circuit destruction due to static electricity are mounted in parallel between the first pin and the second pin and between the first pin and the third pin, and on the board lower surface side, an electrostatic shield layer consisting of a copper foil which does not connect electrically with the second and third pins and connect electrically with the first pin is formed, wherein between the base inner surface side of the connector base and the electrostatic shield layer of the printed wiring board, a magnetic sheet having pin insertion holes for the pins are disposed throughout almost entire surfaces therebetween.

According to a preferred mode of the present invention, taking the above-described magnetic sheet as a first magnetic sheet, a second magnetic sheet is additionally provided on at least one of the outer surface and the inner surface of the shield cover.

Also, as the magnetic sheet, a non-conducting and flexible sheet material containing magnetic powder in a resin is preferably employed.

The present invention also embraces a condenser microphone provided with the output connector having the above-described configuration.

According to the present invention, since the magnetic sheet is disposed between the base inner surface side of the connector base and the electrostatic shield layer of the printed wiring board, an inductance component L caused by the magnetic sheet is provided between the electrostatic shield of the output connector and the microphone cable connected to the output connector, and by this inductance component L and the capacitance component C of the capacitor element mounted on the printed wiring board, a low-pass filter of LC is formed. Therefore, a high-frequency current caused by extraneous electromagnetic waves is less liable to flow into the Zener diode element, and the generation of noise caused by the Zener diode element can be reduced.

Also, because of being thin and flexible, the magnetic sheet can be attached to the existing output connector without a design change.

DETAILED DESCRIPTION

Figure 5A:
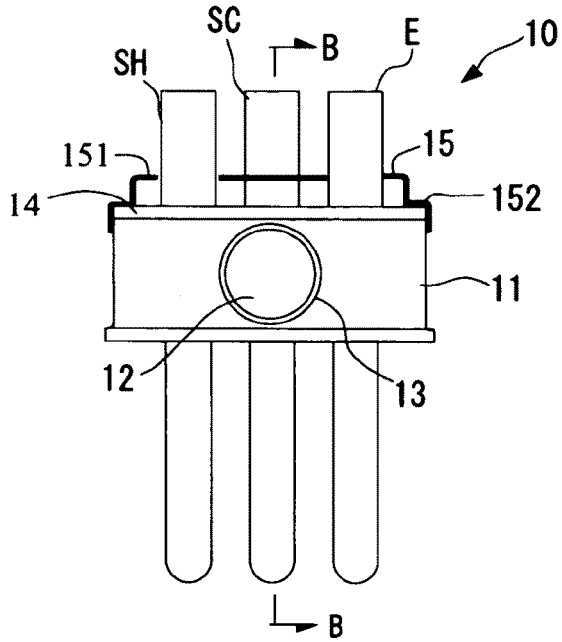
FIG. 5a RELATED ART
FIG. 5A is a front view of a conventional output connector.
Figure 5B:
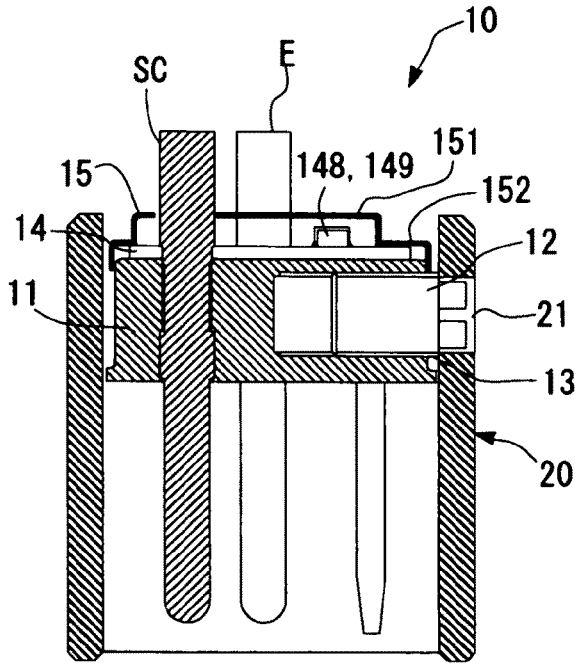
FIG. 5b RELATED ART
FIG. 5B is a sectional view taken along the line B-B of FIG. 5A.

Two embodiments of the present invention will now be described with reference to FIGS. 1 to 4. The present invention is not limited to these embodiments. In the description below, the same reference symbols are applied to elements that need not be changed from the conventional example explained before with reference to FIGS. 5 and 6.

Figure 1A:
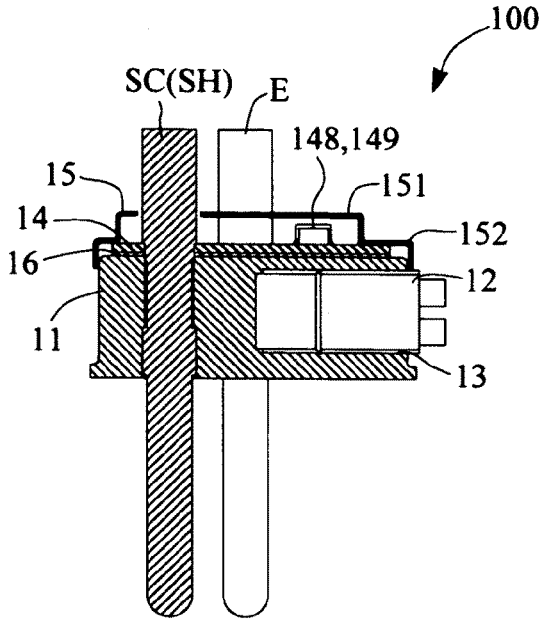
FIG. 1A is a sectional view showing an essential portion of an output connector in accordance with an embodiment of the present invention.
Figure 1B:
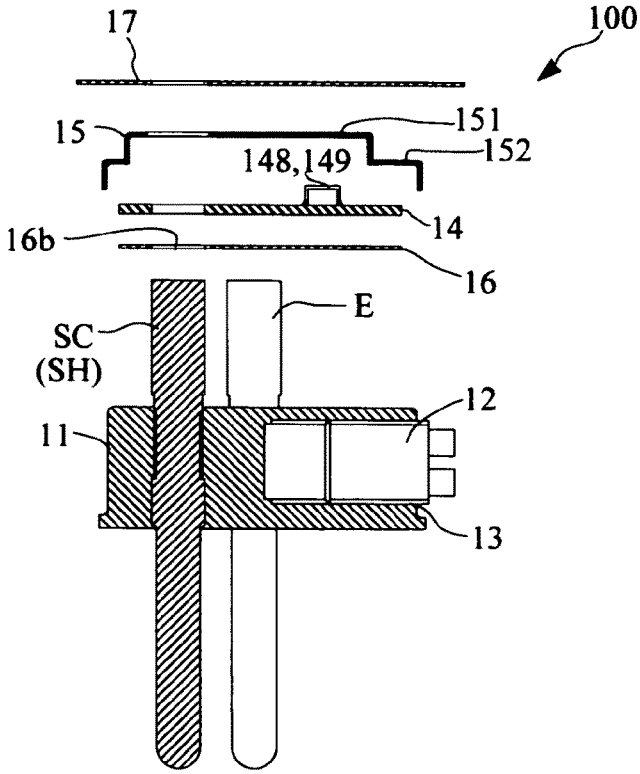
FIG. 1B is an exploded sectional view of FIG. 1A.

Referring to FIGS. 1A and 1B, an output connector 100 in accordance with one embodiment also includes a disc-shaped connector base 11 consisting of an electrical insulator such as PBT (polybutylene terephthalate) resin as in the conventional example.

In the connector base 11, three pins of a first pin E for earthing (an earthing pin E), a second pin SH on the hot side of signal (a signal pin SH), and a third pin SC on the cold side of signal (a signal pin SC) are provided, for example, by press fit.

In the connector base 11, an internally threaded hole 13 is formed toward the inside in the radial direction from the outer peripheral surface thereof. In the internally threaded hole 13, a male screw 12 for fixing the output connector 100 to a connector housing 20 (refer to FIG. 5B) is threadedly mounted.

In this output connector 100 as well, to prevent electromagnetic waves radiated from a cellular phone or the like from intruding into a microphone casing, a printed wiring board 14 and a shield cover 15 are provided on the base inner surface (the surface arranged on the inside of microphone, the upper surface in FIGS. 1A and 1B) side of the connector base 11.

Figure 6A:
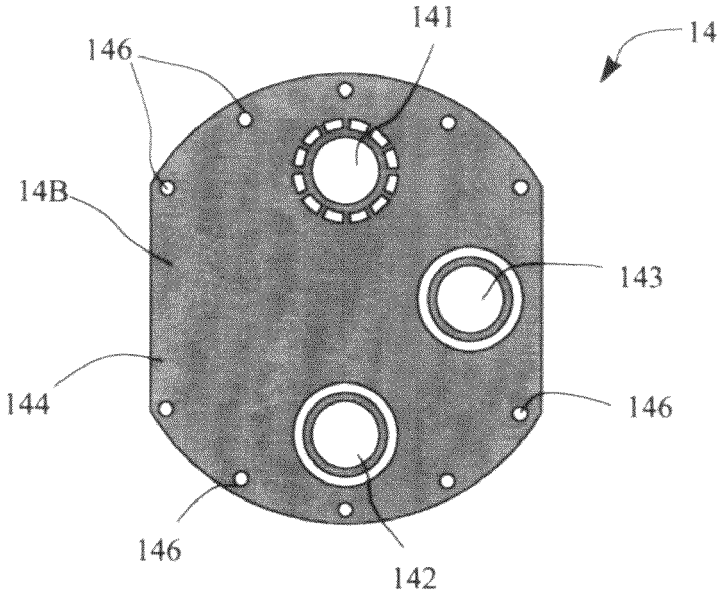
FIG. 6a RELATED ART
FIG. 6A is a lower plan view of a printed wiring board provided in an output connector.
Figure 6B:
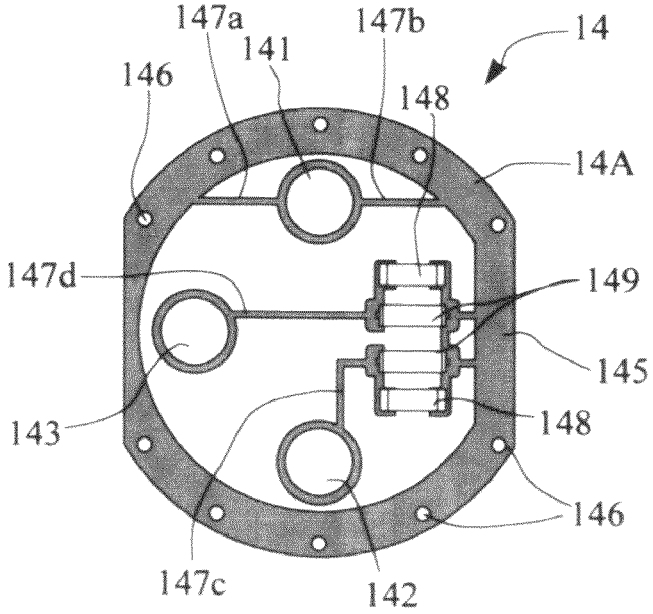
FIG. 6b RELATED ART
FIG. 6B is an upper plan view of a printed wiring board provided in an output connector.

Referring to FIGS. 6A and 6B, the printed wiring board 14 consists of a double-sided printed board having three insertion holes 141, 142 and 143 corresponding to the earthing pin E and the signal pins SH and SC. On the back surface 14B side (a surface facing the base inner surface of the connector base 11), a shield layer 144 consisting of a copper foil solid pattern is formed. On an upper surface 14A on the opposite side of the printed wiring board 14, a capacitor element 148 for preventing intrusion of high-frequency waves and a Zener diode element 149 for preventing circuit destruction due to static electricity are mounted.

The capacitor element 148 and the Zener diode element 149 are connected in parallel to between the earthing pin E and the signal pin SH and to between the earthing pin E and the signal pin SC. The capacitor element 148 functions as a bypass capacitor that allows a high-frequency current, which is caused by extraneous electromagnetic waves going to intrude into the microphone casing through the signal pins SH and SC, to flow from the earthing pin E to the connector housing 20 side serving as the earth.

The shield cover 15 includes a ceiling part 151 that covers the upper surface of the printed wiring board 14 and a skirt part 152 that is fitted on the outer peripheral surface of the connector base 11. In the ceiling part 151, three through holes for the earthing pin E, the signal pins SH and SC (all of these holes are not shown) are formed.

The through hole for the earthing pin E is formed as a hole having a diameter approximately equal to the diameter of the earthing pin E so as to be capable of being in contact with the earthing pin E to electrically connect the earthing pin E and the shield cover 15 to each other. The earthing pin E is finally soldered to the shield cover 15. Thereby, the shield cover 15 is also connected electrically to the shield layer 144, which is formed on the back surface 4B side of the printed wiring board 14, via the earthing pin E.

In contrast, the through holes for the signal pins SH and SC in the shield cover 15 are formed so as to have diameters larger than the diameters of the signal pins SH and SC so as to be in noncontact with the pins.

Because the part mounting surface side of the printed wiring board 14 is covered by the shield cover 15, the leakage of the high-frequency magnetic field into the microphone casing caused by the high-frequency current flowing in the capacitor element 148 is prevented.

When a current flows from the signal pins SH and SC toward the earthing pin E, the current flows on the Zener diode element 149 side, and then flows on the capacitor element 148 side. Therefore, the capacitor element 148 can be protected from electrostatic destruction.

However, since the Zener diode element 149 is also a semiconductor non-linear element, when a high-frequency current caused by strong electromagnetic waves applied to a microphone cable flows in the signal pins SH and SC, the high-frequency current is detected, and audible frequency noise is sometimes generated.

To prevent the generation of noise caused by the Zener diode element 149, as shown in FIGS. 1A and 1B, in the present invention, a magnetic sheet 16 is disposed between the base inner surface of the connector base 11 and the shield layer 144 of the printed wiring board 14.

As the magnetic sheet 16, a non-conducting and flexible sheet material that is a thin film containing magnetic powder in a resin is preferably employed. As a commercially-available magnetic sheet, for example, a noise suppression sheet of a thin and environment-compatible type (thickness: 0.05 mm, 0.1 mm) manufactured by TDK Corporation is available.

Figure 2A:
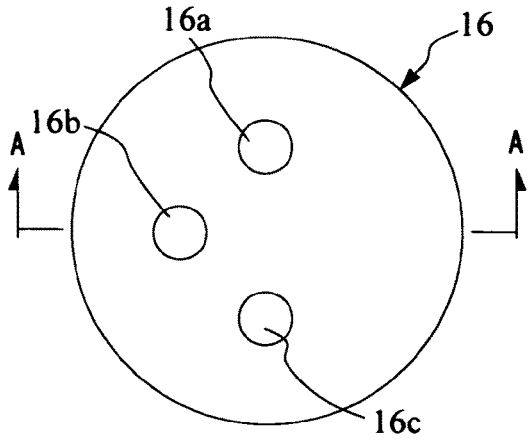
FIG. 2A is a plan view of a magnetic sheet applied to the present invention.
Figure 2B:
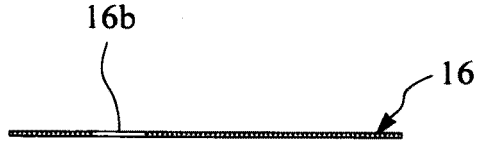
FIG. 2B is a sectional view taken along the line A-A of FIG. 2A.

As shown in FIGS. 2A and 2B, the magnetic sheet 16 is formed with pin insertion holes 16*a*, 16*b* and 16*c* having diameters substantially equal to the outside diameters of the earthing pin E and the signal pins SH and SC. These pin insertion holes 16*a*, 16*b* and 16*c* are preferably attached to the pins in a state of adhering closely to the pins so that no gas is formed around the earthing pin E and the signal pins SH and SC.

Figure 3:
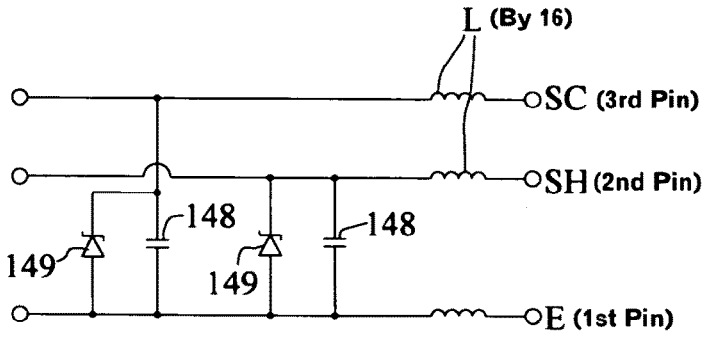
FIG. 3 is an equivalent circuit diagram of a low-pass filter consisting of a magnetic sheet and a capacitor element.
Figure 4A:
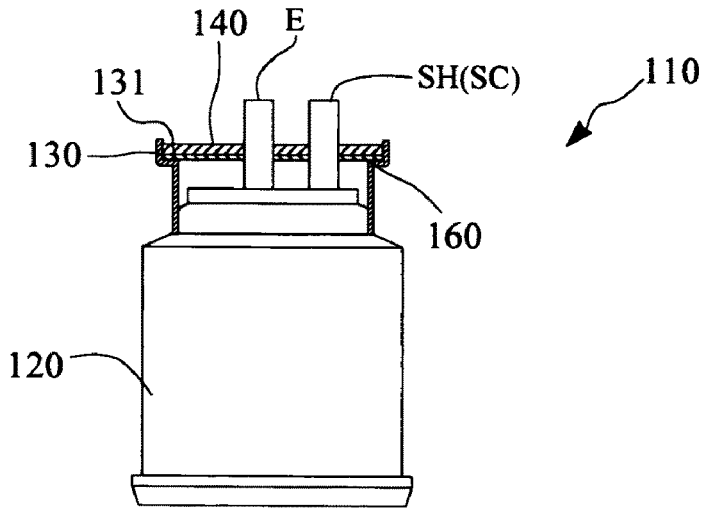
FIG. 4A is a partially sectioned side view of an output connector in accordance with another embodiment of the present invention.
Figure 4B:
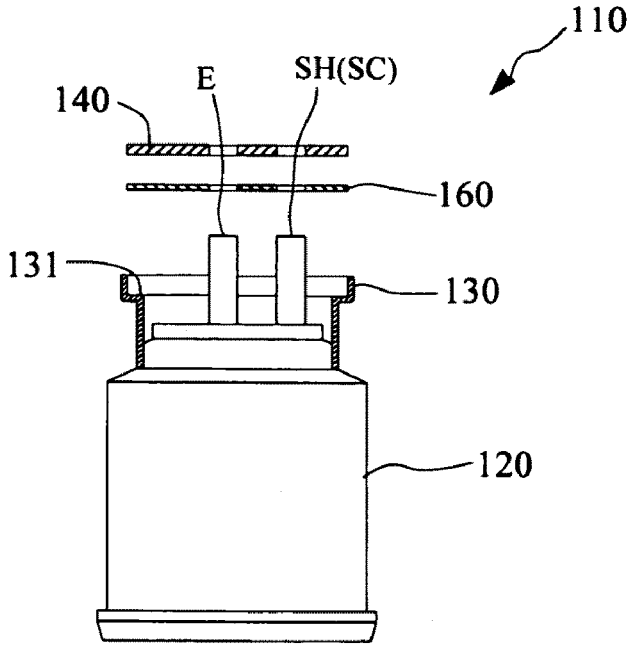
FIG. 4B is an exploded sectional view of FIG. 4A.

Thus, according to the present invention, by the magnetic sheet 16 disposed between the base inner surface of the connector base 11 and the shield layer 144 of the printed wiring board 14, an inductance component L caused by the magnetic sheet 16 is provided between the electrostatic shield provided by the shield layer 144 of the output connector and the microphone cable connected to the output connector, and by this inductance component L and the capacitance component C of the capacitor element 148 mounted on the printed wiring board 14, a low-pass filter of LC is formed as shown in the equivalent circuit shown in FIG. 3. According to this configuration, the high-frequency current caused by extraneous electromagnetic waves is less liable to flow into the Zener diode element 149, and the generation of noise caused by the Zener diode element 149 can be reduced effectively.

Also, because of being thin and flexible, the magnetic sheet can be attached to the existing output connector without a design change.

Due to the high-frequency magnetic field generated by the flow of a high-frequency current in the capacitor element 148, a high-frequency current is caused to flow by induction in the printed wiring board for sound signal output in the microphone casing and the circuit parts mounted on the printed board. To prevent, the generation of noise caused by this high-frequency current, as shown in FIG. 1B, a magnetic sheet 17 is preferably provided additionally on the outer surface (and/or the inner surface) of the shield cover 15. According to this configuration, a multistage filter is formed, so that the generation of noise can be reduced more effectively. As the magnetic sheet 17, a magnetic sheet that is the same as the magnetic sheet 16 may be used.

Next, an output connector 110 in accordance with another embodiment of the present invention is explained. This output connector 110 is of a three-pin type mounted in the end portion of the microphone casing like the output connector 100 of the above-described embodiment, and is provided with a cylindrical receptacle 120 made of a metal.

The receptacle 120 houses the connector base through which the earthing pin E and the signal pins SH and SC are penetratingly provided by press fit. The three pins project from the bottom side of the receptacle 120.

The output connector 110 is provided with a shield casing 130, which consists of a cylindrical and metallic member electrically integral with the receptacle 120, on the bottom side of the receptacle 120. In a flange-shaped receiving part 131 on the tip end side of the shield casing 130, a printed wiring board 140 is fitted via a magnetic sheet 160.

As shown in FIGS. 6A and 6B, in this embodiment, the printed wiring board 140 may have the same configuration as that of the printed wiring board 14 explained in the above-described embodiment. On the upper surface side of the printed wiring board 140, the capacitor element 148 and the Zener diode element 149 are mounted in parallel. On the lower surface of the printed wiring board 140, the shield layer 144 consisting of the copper foil solid pattern is formed.

The magnetic sheet 160 may also have the same configuration as that of the magnetic sheet 16 explained in the above-described embodiment, and is arranged along the shield layer 144 on the lower surface side of the printed wiring board 140.

Therefore, in this embodiment as well, in the shield casing 130, as shown in the equivalent circuit shown in FIG. 3, a low-pass filter of LC is formed by the inductance component L caused by the magnetic sheet 16 and the capacitance component C of the capacitor element 148 mounted on the printed wiring board 14. Therefore, the high-frequency current caused by extraneous electromagnetic waves is less liable to flow into the Zener diode element 149, and the generation of noise caused by the Zener diode element 149 can be reduced effectively.

The invention claimed is:

1. An output connector for a condenser microphone, in which a first pin for earthing and second and third pins for signal are penetratingly provided in a connector base consisting of an electrical insulator;

the output connector is mounted in an end portion of a microphone casing in a state in which the first pin is electrically connected to the microphone casing;

the output connector includes a printed wiring board, which is arranged on the base inner surface side of the connector base and through which the pins are inserted, and a shield cover, which is arranged on the base inner surface side so as to cover the printed wiring board and through which the pins are inserted; and the printed wiring board is a double-sided board, on the board upper surface side facing the shield cover, a capacitor element for preventing intrusion of high-frequency waves and a Zener diode element for preventing circuit destruction due to static electricity are mounted in parallel between the first pin and the second pin and between the first pin and the third pin, and on the board lower surface side, an electrostatic shield layer consisting of a copper foil which does not connect electrically with the second and third pins and connect electrically with the first pin is formed, wherein between the base inner surface side of the connector base and the electrostatic shield layer of the printed wiring board, a magnetic sheet having pin insertion holes for the pins are disposed throughout almost entire surfaces therebetween.

2. The output connector for a condenser microphone according to claim 1, wherein taking the above-described magnetic sheet as a first magnetic sheet, a second magnetic sheet is additionally provided on at least one of the outer surface and the inner surface of the shield cover.

3. The output connector for a condenser microphone according to claim 1, wherein the magnetic sheet is formed of a non-conducting and flexible sheet material containing magnetic powder in a resin.

4. A condenser microphone provided with the output connector described in claim 1.

* * * * *